US010145051B2

(12) United States Patent
Jeong et al.

(10) Patent No.: US 10,145,051 B2
(45) Date of Patent: Dec. 4, 2018

(54) LAUNDRY TREATMENT APPARATUS

(71) Applicant: LG ELECTRONICS INC., Seoul (KR)

(72) Inventors: Kwanwoong Jeong, Seoul (KR); Yanghwan No, Seoul (KR); Chanho Lee, Seoul (KR); Jihong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 162 days.

(21) Appl. No.: 15/197,823

(22) Filed: Jun. 30, 2016

(65) Prior Publication Data

US 2017/0002503 A1 Jan. 5, 2017

(30) Foreign Application Priority Data

Jun. 30, 2015 (KR) ..... 10-2015-0092774
Jun. 14, 2016 (KR) ..... 10-2016-0073976

(51) Int. Cl.
*D06F 39/08* (2006.01)
*D06F 37/12* (2006.01)
(Continued)

(52) U.S. Cl.
CPC ..... *D06F 39/083* (2013.01); *D06F 37/12* (2013.01); *D06F 37/18* (2013.01); *D06F 37/26* (2013.01);
(Continued)

(58) Field of Classification Search
CPC ..... D06F 21/06; D06F 21/08; D06F 23/04; D06F 29/00; D06F 35/008; D06F 37/12;
(Continued)

(56) References Cited

U.S. PATENT DOCUMENTS 6,351,974 B1 3/2002 Lyu et al.
2009/0106911 A1 4/2009 Kim
(Continued)

FOREIGN PATENT DOCUMENTS

CN 1246552 A 3/2000
CN 1769575 5/2006
(Continued)

OTHER PUBLICATIONS

European Search Report in European Application No. 17161851.5, dated Jul. 21, 2017, 10 pages (with English translation).
(Continued)

*Primary Examiner* — David G Cormier
(74) *Attorney, Agent, or Firm* — Fish & Richardson P.C.

(57) ABSTRACT

A laundry treatment apparatus includes a tub body configured to store water, a tub cover configured to define an upper surface of the tub body, an introduction aperture defined through the tub cover, a supply aperture provided in the tub cover, and configured to enable supply of water into the tub body, a drum that is rotatably provided in the tub body, and that is configured to receive laundry, the drum including an opening in communication with the introduction aperture, a door configured to open and close the introduction aperture, and an ejection unit configured to eject water introduced into the supply aperture to at least one of the door or to the drum.

16 Claims, 7 Drawing Sheets

(51) Int. Cl.

| | |
|---|---|
| ***D06F 39/12*** | (2006.01) |
| ***D06F 39/14*** | (2006.01) |
| ***D06F 37/18*** | (2006.01) |
| ***D06F 37/26*** | (2006.01) |
| ***D06F 39/04*** | (2006.01) |

(52) U.S. Cl.
CPC ..... *D06F 39/04* (2013.01); *D06F 39/088* (2013.01); *D06F 39/12* (2013.01); *D06F 39/14* (2013.01)

(58) Field of Classification Search
CPC ..... D06F 37/18; D06F 37/26; D06F 37/28; D06F 39/08; D06F 39/088; D06F 39/12; D06F 39/14
See application file for complete search history.

(56) References Cited

U.S. PATENT DOCUMENTS

| | | | | |
|---|---|---|---|---|
| 2010/0154132 | A1 | 6/2010 | Im et al. | |
| 2011/0265524 | A1 | 11/2011 | Kim et al. | |
| 2012/0216580 | A1 | 8/2012 | Chung et al. | |
| 2015/0114046 | A1* | 4/2015 | Jeong ..... | D06F 39/083 68/17 R |

FOREIGN PATENT DOCUMENTS

| | | | |
|---|---|---|---|
| CN | 102628206 | | 8/2012 |
| CN | 102733151 | A | 10/2012 |
| CN | 103492627 | | 1/2014 |
| DE | 102005055777 | | 11/2006 |
| EP | 2949803 | | 12/2015 |
| EP | 2980297 | | 2/2016 |
| JP | 2005-304713 | | 11/2005 |
| JP | 2010-268843 | | 12/2010 |
| JP | 2014144070 | A | 8/2014 |
| JP | 2014-212791 | | 11/2014 |
| KR | 10-2000-0066178 | | 11/2000 |
| KR | 10-0336394 | | 5/2002 |
| KR | 10-2015-0028180 | | 3/2015 |

OTHER PUBLICATIONS

European Communication under Rule 71(3) EPC in European Application No. 16176785.0, dated Jul. 17, 2017, 7 pages. (with English translation).
Extended European Search Report issued in European Application No. 16176785.0 dated Aug. 23, 2016, 7 pages.
International Search Report and Written Opinion in International Application No. PCT/KR2016/007022, dated Sep. 12, 2016, 17 pages.
Chinese Office Action in Chinese Application No. 201610514023.3, dated Apr. 3, 2018, 18 pages.
U.S. Office Action in U.S. Appl. No. 15/413,458, dated Apr. 5, 2018, 19 pages.
Canadian Office Action in Canadian Application No. 2,957,630, dated Jul. 3 2018, 4 pages.

* cited by examiner

【FIG 1】
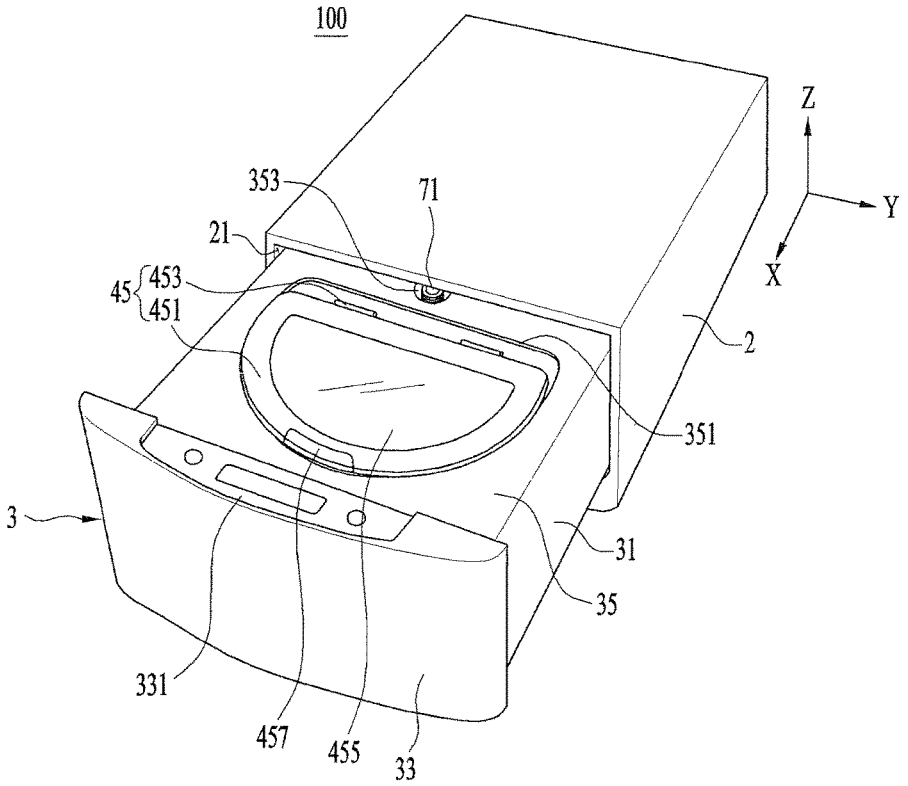

【 FIG 2】
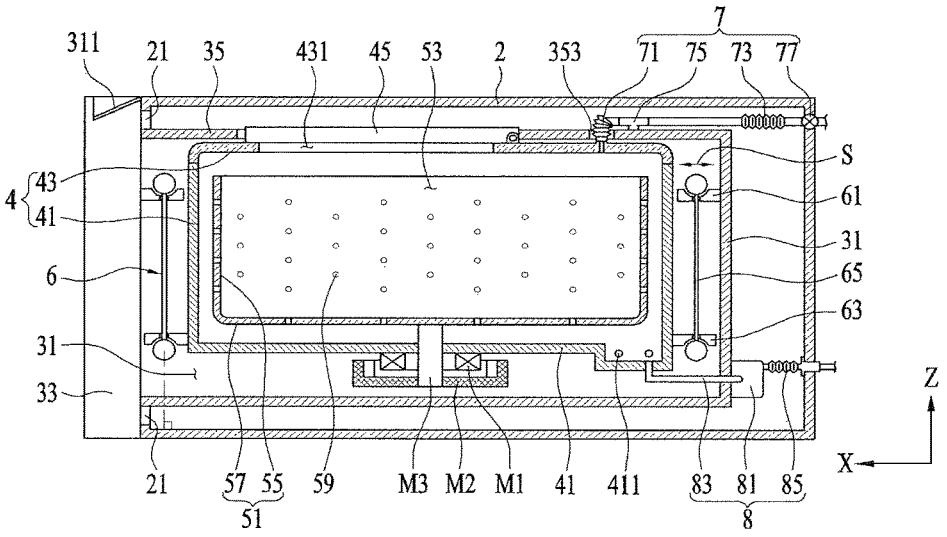

【 FIG 3】
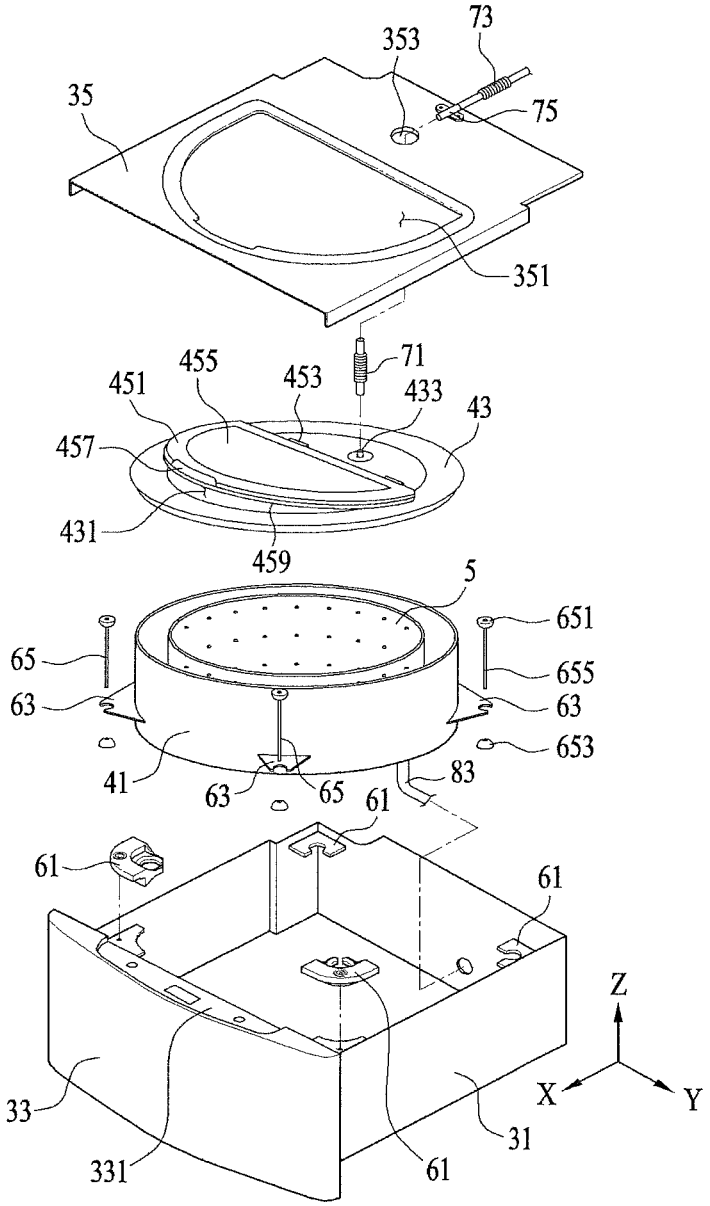

【 FIG 6】
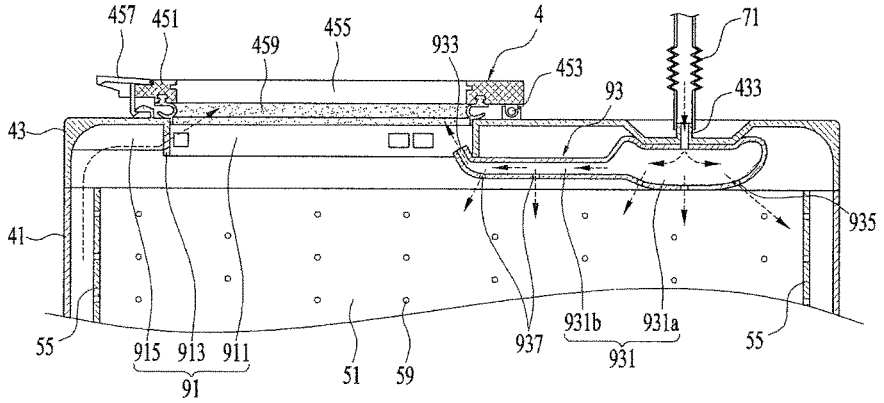

LAUNDRY TREATMENT APPARATUS

This application claims the benefit of Korean Patent Application No. 10-2015-0092774, filed on Jun. 30, 2015 and Korean Patent Application No. 10-2016-0073976, filed on Jun. 14, 2016, which is hereby incorporated by reference as if fully set forth herein.

BACKGROUND

Generally, a laundry treatment apparatus is a generic term for an apparatus that washes laundry (e.g., objects to be washed or objects to be dried), an apparatus that dries laundry, and an apparatus that may perform both washing and drying of laundry.

Conventional laundry treatment apparatuses are classified into front loading type laundry treatment apparatuses which are configured such that laundry is introduced through an introduction aperture formed in the front surface of the apparatus and top loading type laundry treatment apparatuses configured such that laundry is introduced through an introduction aperture formed in the upper surface of the apparatus.

A top loading type laundry treatment apparatus includes a tub having an introduction aperture formed in the upper surface of the apparatus, a drum rotatably provided inside the tub, and a door for opening and closing the introduction aperture.

Some conventional laundry treatment apparatuses having the configuration described above are devised to have a minimum volume in order to wash only a very small amount of laundry. Such a laundry treatment apparatus having a minimum volume has the feature of a very small distance between the introduction aperture and the upper end of the drum.

Impurities which are generated inside the tub when the drum is rotated to wash laundry may remain on the door. That is, because a water stream is generated inside the tub while the drum is rotated, there is the possibility that bubbles, which are generated as the detergent are dissolved, or contaminants discharged from the laundry during washing may remain on the door or inside the drum after the washing is completed.

In addition, in the conventional laundry treatment apparatus, when the bubbles or contaminants remain on the inner surface of the door or on the circumferential surface of the drum despite the completion of washing, a user may erroneously determine that the washing of laundry is not completed or may suspect the failure of the laundry treatment apparatus.

In the conventional laundry treatment apparatus, it is not necessary to minimize the volume of the laundry treatment apparatus, with the result that the tub is relatively high, and the wash water is not stored up to the upper surface of the tub. Even when bubbles are generated, therefore, consideration may not be given to the fact that the bubbles may be stuck to the door. Bubbles or impurities generated during washing of laundry may remain on the door, with the result that the bubbles or the impurities may be stuck to the laundry after the washing is completed, thereby reducing washing efficiency.

In the conventional laundry treatment apparatus, when the pressure of the wash water flowing in the additional flow channel is excessively increased, the flow channel may be broken, with the result that the wash water may leak or the wash water may flow backward. The conventional laundry treatment apparatus does not prevent bubbles from being generated in the drum.

SUMMARY

According to one aspect, a laundry treatment apparatus may include a tub body configured to store water, a tub cover configured to define an upper surface of the tub body, an introduction aperture defined through the tub cover, a supply aperture provided in the tub cover, and configured to enable supply of water into the tub body, a drum that is rotatably provided in the tub body, and that is configured to receive laundry, the drum including an opening in communication with the introduction aperture, a door configured to open and close the introduction aperture, and an ejection unit configured to eject water introduced into the supply aperture to at least one of the door or to the drum.

Implementations according to this aspect may include one or more of the following features. For example, the ejection unit may include a chamber configured to guide water supplied through the supply aperture toward the introduction aperture, and a chamber discharge unit configured to discharge water introduced into the chamber to the door. The chamber may include an inlet chamber located under the supply aperture, and a connection chamber configured to guide water introduced into the inlet chamber to the chamber discharge unit. A cross-sectional area of the connection chamber may be smaller than a cross-sectional area of the inlet chamber. A cross-sectional area of the chamber discharge unit may be smaller than a cross-sectional area of the connection chamber. The door may be located above the introduction aperture, and the connection chamber may be configured to tilt to allow water discharged from the chamber discharge unit to be supplied to the door. The door may include a frame rotatably coupled to the tub cover and a window provided in the frame, the window comprising a transparent material, and the connection chamber may be configured to tilt to allow water discharged from the chamber discharge unit to be supplied to the window. The chamber further may include an inlet chamber discharge unit that is defined through the inlet chamber and that is configured to eject water to the drum. The drum may include a cylindrical drum body with the opening defined at an upper surface of the drum, and the inlet chamber discharge unit may be configured to eject water toward at least one of a bottom surface or and a circumferential surface of the drum body. The chamber may further include a connection chamber discharge unit that is defined through the connection chamber and that is configured to eject water to the drum. The drum may include a cylindrical drum body with the opening defined at an upper surface of the drum, and the connection chamber discharge unit may include a plurality of connection chamber discharge units, at least one of the connection chamber discharge units being configured to eject water to a circumferential surface of the drum body. The chamber may further include a pressure reduction unit provided in at least one of the inlet chamber or the connection chamber, the pressure reduction unit being configured to discharge water from the chamber to the drum based on a pressure in the chamber being equal to or greater than a predetermined reference pressure.

The laundry treatment apparatus may include a rotating shaft configured to rotate the drum, and a one or more washing unit configured to eject at least some water moved toward the tub cover to the door using centrifugal force generated while the drum is rotated. The rotating shaft may be configured to extend from a bottom surface of the tub body toward the introduction aperture. The washing unit may include a guide that extends from an edge of the tub cover toward the introduction aperture. The washing unit may further include a discharge unit configured to discharge water supplied through the guide in a direction in which the door is located. The washing unit may include a plurality of washing units, at least two of the washing units being arranged to face each other. The guide may include a first guide configured to guide water moved to the tub cover to the discharge unit based on the drum being rotated in a clockwise direction, and a second guide configured to guide water moved to the tub cover to the discharge unit based on the drum being rotated in a counterclockwise direction. The washing unit may further include a barrier that protrudes from the tub cover toward an upper surface of the drum, and the discharge unit may include a first discharge unit that is defined through the barrier and that is configured to discharge water supplied through the first guide, and a second discharge unit that is defined through the barrier and that is configured to discharge water supplied through the second guide. Each of the first discharge unit and the second discharge unit is inclined such that a path of water discharged from the first discharge unit and a path of water discharged from the second discharge unit cross each other. The laundry treatment apparatus may further include a cabinet, and a drawer configured to support the tub body. The laundry treatment apparatus may further include a rotating shaft configured to rotate the drum, where the door includes a frame rotatably coupled to the tub cover, a window provided in the frame such that an inside of the tub body is visible from an outside of the tub body, and a washing guide configured to guide at least some water moved to an edge of the frame to the window using centrifugal force generated while the drum is rotated. An end of the introduction aperture may be concavely bent toward the drum, and an upper part of the inlet chamber may correspond to a shape of the introduction aperture such that the upper part of the inlet chamber is configured to receive the end of the introduction aperture based on the upper part of the inlet chamber being in contact with the end of the introduction aperture. The inlet chamber discharge unit may be provided in an edge of a lower part of the inlet chamber and in a middle portion of the lower part of the inlet chamber. The pressure reduction unit may include a chamber through-hole defined through one of the inlet chamber or the connection chamber, and an elastic body provided in the chamber through-hole that is configured to open the chamber through-hole based on pressure applied to the chamber through-hole being equal to or greater than a reference pressure. The elastic body may be configured to have one end connected to the inlet chamber and the other end separate from the connection chamber.

BRIEF DESCRIPTION OF THE DRAWINGS

FIGS. 1 and 2 are views illustrating an example of a laundry treatment apparatus;

FIG. 3 is a view illustrating an example of the coupling relationship between a drawer, a tub, and a drum;

FIGS. 5A and 5B are views illustrating an example of a washing guide and FIGS. 6 to 7B are views illustrating a second example of an ejection unit.

DETAILED DESCRIPTION

Figure 4A:
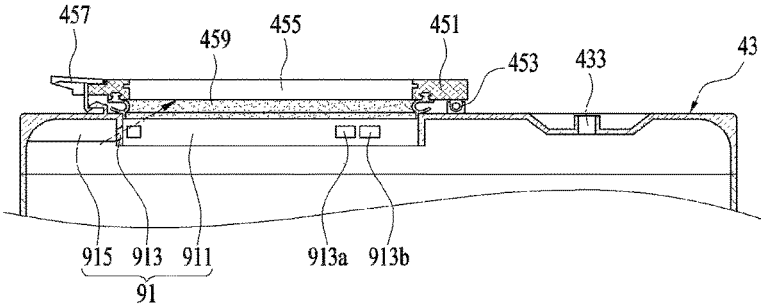
FIGS. 4A and 4B are views illustrating an example of an ejection unit

As illustrated in FIGS. 1 and 2, a laundry treatment apparatus 100 may include a cabinet 2, a drawer 3 provided to be discharged from the cabinet 2, a tub 4 provided inside the drawer 3 for storing water therein, and a drum 5 rotatably provided inside the tub 4 for storing laundry therein.

The cabinet 2 may serve to define the external appearance of the laundry treatment apparatus 100, and may also simply serve as a space in which the drawer 3 is received. The cabinet 2 may be provided in the front surface of the apparatus with an opening 21 for the insertion of the drawer 3.

The drawer 3 includes a drawer body 31 configured to be inserted into the inside of the cabinet 2 through the opening 21, a drawer panel 33 fixed to the front surface of the drawer body 31 for opening and closing the opening 21, and a drawer cover 35 for forming the upper surface of the drawer body 31.

Because the drawer panel 33 is fixed to the front surface of the drawer body 31, the drawer panel 33 may serve as a handle for discharging the drawer body 31 from the cabinet 2.

The drawer panel 33 may be provided with a control panel 331, which is used to input a control command associated with the operation of the laundry treatment apparatus 100 and to notify a user of a message associated with the operation of the laundry treatment apparatus 100.

The drawer body 31 may have any shape that can be inserted into the cabinet 2 through the opening 21 and can provide a space in which the tub 4 is received. FIG. 1 illustrates a hollow drawer body 31 having a hexahedral shape by way of example.

The drawer cover 35 has a first through-hole 351 and a second through-hole 353 for communicating the inside of the drawer body 31 with the outside. The first through-hole 351 may be provided for the introduction and discharge of laundry, and the second through-hole 353 may be provided to supply water required to wash the laundry.

As illustrated in FIG. 2, the tub 4 includes a tub body 41 located inside the drawer body 31 for storing water therein, and a tub cover 43 for forming the upper surface of the tub body 41. The tub body 41 may take the form of a cylinder having an open upper surface. A heater 411 for heating water may be provided in the tub body 41.

The tub cover 43 may have an introduction aperture 431 for communicating the inside of the tub body 41 with the outside of the tub body 41, and a supply aperture 433 for introducing water into the tub body 41.

The introduction aperture 431 may be provided under the first through-hole 351 provided in the drawer cover 35, and the supply aperture 433 may be provided to communicate with the second through-hole 353 provided in the drawer cover 35.

The introduction aperture 431 serves to allow laundry to be introduced into the tub body 41, or serves to allow the laundry inside the tub body 41 to be discharged to the outside of the tub body 41. The introduction aperture 431 is opened and closed by a door 45.

As illustrated in FIG. 3, the door 45 may include a frame 451 rotatably coupled to the tub cover 43 via a hinge 453, a window 455 provided in the frame 451, and a door handle 457 for separably coupling the frame 451 to the tub cover 43. The window 455 may be formed of a transparent material to allow the user to view the inside of the tub body 41 when the drawer 3 is discharged from the cabinet 2.

Meanwhile, in order to prevent the water inside the tub body 41 from being discharged to the outside of the tub body 41 through the introduction aperture 431, any one of the frame 451 and the tub cover 43 may be provided with a sealing unit 49 for hermetically sealing a space between the frame 451 and the introduction aperture 431 when the door 45 closes the introduction aperture 431.

The tub 4 having the configuration described above is coupled to the drawer body 31 via a tub support unit 6. The tub support unit 6 may include a first support member 61 provided at the drawer body 31, a second support member 63 provided at the tub body 41, and a connector 65 for connecting the first support member 61 and the second support member 63 to each other.

The connector 65 may include a first connection piece 651 configured to be seated in the first support member 61, a second connection piece 653 for supporting the second support member 63, and a bar 655 for connecting the first connection piece 651 and the second connection piece 653 to each other.

The first connection piece 651 may be shaped to be movable in the first support member 61 while being seated in the first support member 61. The second connection piece 653 may be shaped to support the second support member 63 and to be movable in the second support member 63.

As illustrated in FIG. 2, the bar 655 may form a right angle with respect to the bottom surface of the cabinet 2 (i.e. may be provided parallel to the height direction Z of the cabinet 2 or provided to be orthogonal to the bottom surface of the drawer 3).

At least three tub support units 6 are provided to couple the tub body 41 to the drawer body 31, and the bars 655 form a right angle with respect to the bottom surface of the cabinet 2. The distance between the tub cover 43 and the drawer cover 35 may be increased when compared to the case where the bars 655 are tilted at a prescribed angle relative to the Z-axis.

The tub support units 6 may reduce the possibility of the tub cover 43 colliding with the drawer cover 35 when the tub body 41 vibrates inside the drawer body 31.

When the bars 655 are provided to form a right angle with respect to the bottom surface of the drawer 3, at least one of the first support member 61 and the second support member 63 may be separably coupled to the drawer body 31.

When at least three tub support units 6 are provided and both the first support member 61 and the second support member 63 are inseparable from the drawer body 31, a user who attempts to fix the tub body 41 to the drawer body 31 first needs to insert the tub body 41 into the drawer body 31 to prevent the first support member 61 from interfering with the second support member 63, and then needs to rotate the tub body 41 so that the second support member 63 and the first support member 61 are located on the vertical axis, in order to couple the first connection piece 651 to the first support member 61.

Although the feature by which the bar 655 of the tub support unit 6 is provided to form a right angle with respect to the bottom surface of the drawer 3 serves to minimize the distance between the outer circumferential surface of the tub body 41 and the inner circumferential surface of the drawer body 31 to minimize the volume of the laundry treatment apparatus 100, the strength of assembly of the first connection piece 651 and the first support member 61 may be deteriorated while the process described above is performed. This problem may be solved by making the first support member 61 separable from the drawer body 31.

The drum 5, which is provided inside the tub 4, may include a cylindrical drum body 51 having an opening 53 formed in the upper surface thereof. The opening 53 is located below the introduction aperture 431, and the laundry supplied through the introduction aperture 431 may be supplied to the drum body 51 through the opening 53.

A plurality of drum through-holes 59 may be provided in the bottom surface 57 and the circumferential surface 55 of the drum body 51 for communication of the inside of the drum body 51 and the tub body 41.

The drum body 51 may be rotated inside the tub body 41 by a drive unit. The drive unit may include a stator M1 located outside the tub body 41 and fixed to the bottom surface of the tub body 41, a rotor M2 configured to be rotated by a rotating magnetic field provided by the stator M1, and a rotating shaft M3 penetrating the bottom surface of the tub body 41 for connecting the bottom surface 57 of the drum 5 and the rotor M3 to each other. The rotating shaft M3 may be provided to form a right angle with respect to the bottom surface of the tub body 41.

The laundry treatment apparatus 100 may supply water to the tub 4 via a water supply unit 7, and may discharge the water stored in the tub 4 to the outside of the cabinet 2 via a drain unit 8.

As illustrated in FIG. 2, the water supply unit 7 may include a first water supply pipe 71 connected to the supply aperture 433 formed in the tub cover 43, a second water supply pipe 73 connected to a water supply source, which is located at the outside of the cabinet 2, and a connection pipe 75 fixed to the tub cover 43 for connecting the first water supply pipe 71 and the second water supply pipe 73 to each other.

The first water supply pipe 71 may connect the supply aperture 433 and the connection pipe 75 to each other through the second through-hole 353 provided in the drawer cover 35. The first water supply pipe 71 may be a corrugated pipe in order to prevent the first water supply pipe 71 from being separated from the connection pipe 75 when the tub 4 vibrates (see FIG. 3).

In addition, the second water supply pipe 73 may also be a corrugated pipe in order to prevent the second water supply pipe 73 from being separated from the connection pipe 75 when the drawer 3 is discharged from the cabinet 2. The second water supply pipe 73 may be opened and closed by a water supply valve 77, which is controlled by a controller.

In some examples, the water supply unit 7 may include a single water supply pipe for connecting a water supply source, which is located at the outside of the cabinet 2, to the supply aperture 433 provided in the tub cover 43. In this example, the water supply pipe may be a corrugated pipe.

The drain unit 8 may include a drain pump 81 fixed to the drawer body 31, a first drain pipe 83 for guiding the water inside the tub body 41 to the drain pump 81, and a second drain pipe 85 for guiding the water discharged from the drain pump 81 to the outside of the cabinet 2. The second drain pipe 85 may be a corrugated pipe.

In the laundry treatment apparatus 100, after laundry is introduced into the drum 5 and water and detergent are supplied to the tub 4, the drum 5 is rotated via the drive unit to wash the laundry.

Because a water stream is generated inside the tub 4 while the drum 5 is rotated, there is the possibility that bubbles, which are generated as the detergent is dissolved, or contaminants discharged from the laundry during washing may remain on the door 45 after the washing is completed.

When bubbles or contaminants remain on the inner surface of the door 45 despite the completion of washing, the user may erroneously determine that the washing of laundry is not completed or may suspect the failure of the laundry treatment apparatus 100.

The laundry treatment apparatus 100 may further include at least one of a washing unit 91 and an ejection unit 93 for removing impurities (bubbles, contaminants or the like) remaining on the door 45.

Figure 4B:
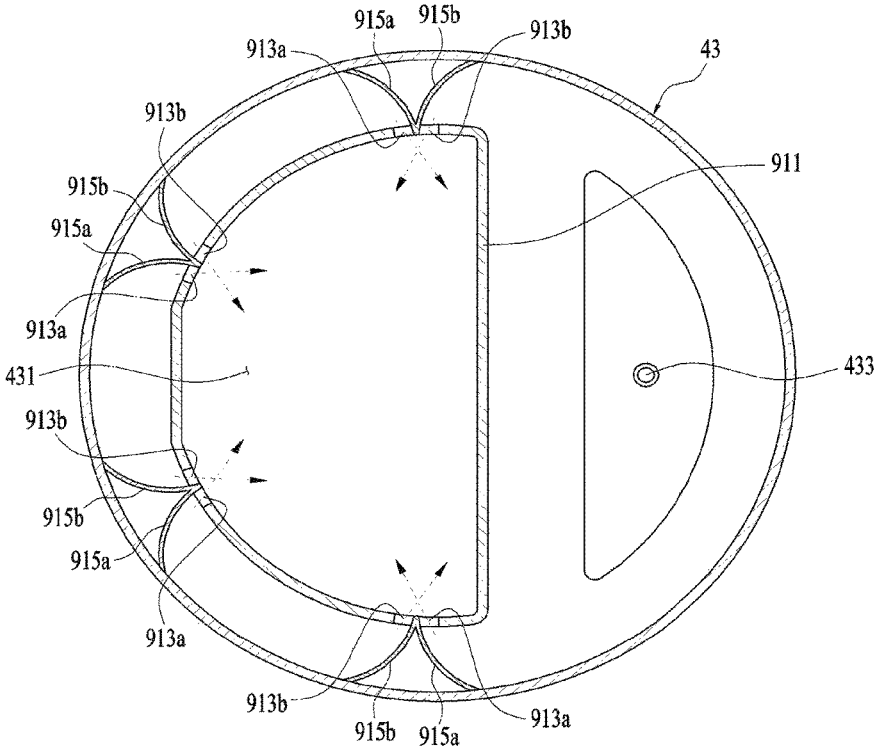

As illustrated in FIGS. 4A and 4B, the washing unit 91 serves to wash the door 45 using the centrifugal force generated while the drum 5 is rotated.

In the drum 5, because the rotating shaft M3, which forms the center of rotation, forms a right angle with respect to the bottom surface of the tub body 41, the water inside the tub 4 is moved upward along the circumferential surface of the tub body 41 by centrifugal force while the drum 5 is rotated, and thereafter is moved to the introduction aperture 431 along the tub cover 43. The washing unit 91 may serve to discharge the water, moved to the tub cover 43 by centrifugal force, in the direction in which the door 45 is located, thereby washing the door 45.

The washing unit 91 may include a guide 915 extending from the edge of the tub cover 43 toward the introduction aperture 431, a barrier 911 protruding from the tub cover 43 toward the upper surface of the drum 5, and a discharge unit 913 formed through the barrier 911 for the discharge of water, supplied through the guide 915, in the direction in which the door 45 is located.

The barrier 911 may be provided to surround the entire introduction aperture 431, as illustrated in FIG. 4B. In some examples, a plurality of barriers may be spaced apart from one another along the edge of the introduction aperture.

As illustrated in FIG. 4B the barrier 911 may protrude from the edge of the introduction aperture 431 toward the drum 5.

When the door 45 is rotatably coupled to the upper surface of the tub cover 43 so that the inner surface of the door 45 (i.e. the surface of the door 45 that is in contact with water) is located higher than the discharge unit 913, the discharge unit 913 may be inclined at a prescribed angle to allow water to be discharged toward the door 45.

In addition, when the door 45 includes the window 455 formed of a transparent material, the discharge unit 913 may be inclined to allow water to be discharged to the window 455.

The guide 915 may include a first guide 915*a* and a second guide 915*b*. The first guide 915*a* guides water, moved to the edge of the tub cover 43, to the discharge unit 913 when the drum 5 is rotated in the clockwise direction. The second guide 915*b* guides water, moved to the edge of the tub cover 43, to the discharge unit 913 when the drum 5 is rotated in the counterclockwise direction.

In the case where the discharge unit 913 is a single hole formed in the barrier 911, the respective guides 915*a* and 915*b* may guide water to the same discharge unit 913. However, in the case where the discharge unit 913 includes a first discharge unit 913*a* and a second discharge unit 913*b* formed in the barrier 911, the first guide 915*a* may guide water to the first discharge unit 913*a*, and the second guide 915*b* may guide water to the second discharge unit 913*b*.

The washing unit 91 may wash the door 45 regardless of the direction in which the drum 5 is rotated so long as the number of revolutions per minute of the drum 5 is a preset reference number of revolutions per minute (i.e. the number of revolutions per minute by which the water inside the tub body 41 is moved upward to the tub cover 43).

In addition, the respective discharge units 913*a* and 913*b* may be inclined at a prescribed angle so that the path of water discharged from the first discharge unit 913*a* and the path of water discharged from the second discharge unit 913*b* cross each other. This serve to increase the washing range of the washing unit 91.

The washing unit 91 may be provided in a plural number along the edge of the introduction aperture 431, and the washing units 91 may be arranged to surround the introduction aperture 431. In addition, at least two of the washing units 91 may be arranged s to face each other. This may serve to increase the washing capability of the washing unit 91.

Figure 5A:
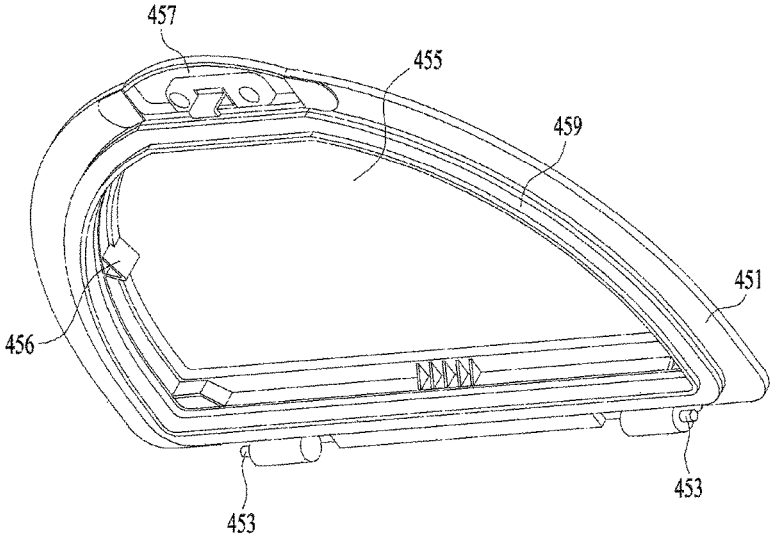
Figure 5B:
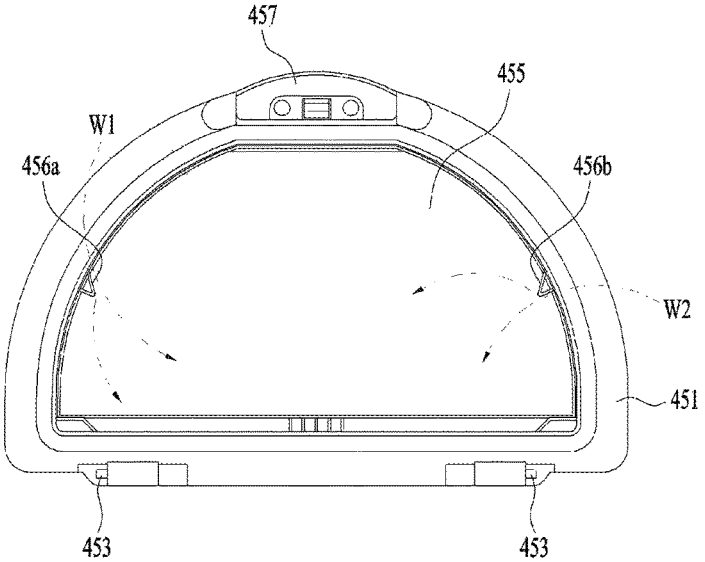

The impurities remaining on the door 45 may be removed by a washing guide 456 illustrated in FIGS. 5A and 5B. The washing guide 456 may be provided at the edge of the window 455. During the rotation of the drum, water in the tub may move from the bottom surface of the tub to the edge of the frame 451 due to centrifugal force generated while the drum is rotated. The water may move around the edge of the frame 451. In the case in which the washing guide 456 is provided at the edge of the window, the water moving around the edge of the frame 451 may be guided toward the middle of the window 455 (W1 and W2). Consequently, it is possible to prevent the impurities from remaining on the window by the provision of the washing guide 456.

In order to maximize the washing area, the washing guide 456 may include a first washing guide 456*a* and a second washing guide 456*b* disposed so as to be symmetric with respect to a line of symmetry Q of the door 45, as illustrated in FIG. 5B.

In some examples, one of the washing unit 91 and the washing guide 456 may be provided, and in some other examples both the washing unit 91 and the washing guide 456 may be provided.

The ejection unit 93 illustrated in FIG. 6 may be configured to eject water supplied to the tub 4 to at least one of the door 45 and the drum 5 to wash the door 45. The ejection unit 93 may include a chamber 931 for guiding water, supplied to the supply aperture 433 provided in the tub cover 43, toward the introduction aperture 431, and a chamber discharge unit 933 for discharging the water introduced into the chamber 931 to the door 45.

The chamber 931 includes an inlet chamber 931*a* located under the supply aperture 433, and a connection chamber 931*b* for guiding the water introduced into the inlet chamber 931*a* to the chamber discharge unit 933.

Figure 7A:
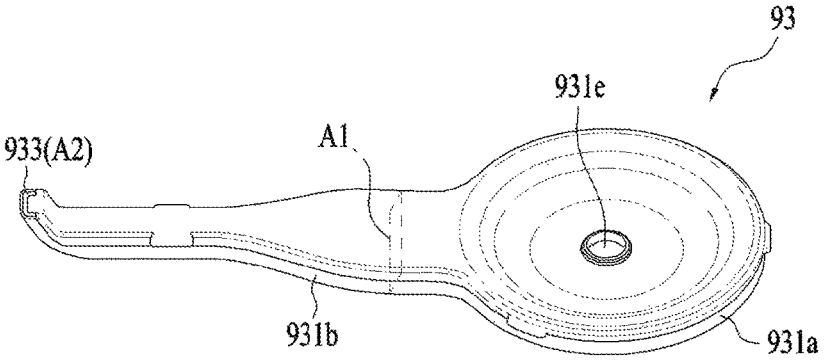
Figure 7B:
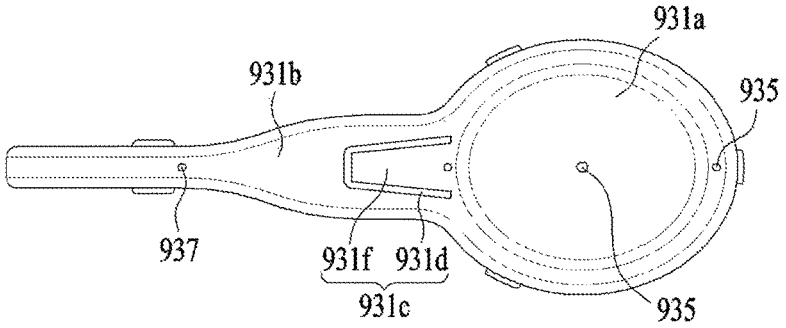

As illustrated in FIGS. 7A and 7B, the inlet chamber 931*a* may have a communication hole 931*e* connected to the supply aperture 433. In order to increase the pressure of water to be discharged through the chamber discharge unit 933, the cross-sectional area A1 of the connection chamber 931*b* may be smaller than the cross-sectional area of the inlet chamber 931*a*. In addition, the cross-sectional area A2 of the chamber discharge unit 933 may be smaller than the cross-sectional area A1 of the connection chamber 931*b*.

The connection chamber 931*b* may be tilted at a prescribed angle so that water ejected from the chamber discharge unit 933 is supplied to the door 45, which is located above the introduction aperture 431.

In some examples where the door 45 includes the window 455, the tilt angle of the connection chamber 931*b* may be set to an angle at which water ejected from the chamber discharge unit 933 may be supplied to the window 455.

The inlet chamber 931*a* may further include an inlet chamber discharge unit 935 for ejecting some of the water inside the inlet chamber 931*a* into the drum 5.

The inlet chamber discharge unit 935 may be provided to eject water toward the bottom surface 57 of the drum body, or may be provided to eject water toward the circumferential surface 55 of the drum body.

When the inlet chamber discharge unit 935 is provided to eject water toward the bottom surface 57 of the drum body, the inlet chamber discharge unit 935 may serve to remove bubbles generated inside the drum 5 by ejecting water into the drum 5 during washing.

When the controller controls the water supply valve 77 during washing to supply water to the chamber 931, bubbles generated inside the tub 4 during washing are removed, which may prevent impurities, including the bubbles, from remaining on the door 45.

In other examples, when the inlet chamber discharge unit 935 is provided to eject water toward the circumferential surface 55 of the drum body, the inlet chamber discharge unit 935 may serve to wash the circumferential surface 55 of the drum 5.

When the controller controls the water supply valve 77 to supply water to the chamber 931 after washing is completed and also rotates the drum 5, impurities remaining on the surface of the drum 5 may be washed by the water discharged from the inlet chamber discharge unit 935.

In addition, the connection chamber 931*b* may further have a connection chamber discharge unit 937 for discharging water to the drum 5.

At least two connection chamber discharge units 937 may be provided. In some examples, one connection chamber discharge unit 937 may be provided to discharge water toward the bottom surface 57 of the drum body, and the other connection chamber discharge unit 937 may be provided to discharge water toward the circumferential surface 55 of the drum body.

The inlet chamber discharge unit 935 and the connection chamber discharge unit 937 may be disposed at the edge of the drum 5 toward the center of rotation of the drum 5. When the drum 5 is rotated, therefore, it is possible to eject water over the entire area of the drum, thereby effectively removing bubbles from the drum.

In some examples, the door 45 may open the introduction aperture 431 due to the discharge of water from the chamber discharge unit 933 when the pressure of the water supplied through the water supply unit 7 is high (i.e. the pressure in the chamber 93 is high).

The chamber 93 may further include a pressure reduction unit 931*c* for discharging water from the chamber 93 to the drum 5 when the pressure in the chamber is equal to or greater than a predetermined reference pressure.

The pressure reduction unit 931*c* may be provided in at least one of the inlet chamber 931*a* and the connection chamber 931*b*. FIGS. 7A and 7B illustrates an example in which the pressure reduction unit 931*c* is provided in the connection chamber 931*b*.

The pressure reduction unit 931*c* may include a chamber through-hole 931*d* formed through the connection chamber 931*b* and an elastic body 931*f* provided in the chamber through-hole 931*d* for opening the chamber through-hole 931*d* when the pressure in the connection chamber 931*b* is equal to or greater than a reference pressure. The laundry treatment apparatus may prevent impurities, generated inside a tub during washing from remaining on a door.

The laundry treatment apparatus may wash the door using the centrifugal force generated by water stored in a tub while a drum is rotated. The laundry treatment apparatus may include an ejection unit for washing a door using a device for supplying water to a tub. The laundry treatment apparatus may include an additional flow channel for removing bubbles or impurities from a door, and may selectively drain water from a device for removing bubbles or impurities when the pressure in the device for removing bubbles or impurities is excessively increased, thereby preventing water leakage or the backward flow of wash water.

What is claimed is:

1. A laundry treatment apparatus comprising:
- a tub body configured to store water;
- a drum that is rotatably provided in an interior of the tub body and that is configured to receive laundry through a first opening at the top of the drum; and
- a tub cover configured to cover the tub body and having a second opening formed therethrough that provides access to an interior of the drum, the tub cover comprising:
  - a tub cover door configured to open and close the second opening formed through the tub cover;
  - a supply aperture configured to supply water into the interior of the drum; and
  - an ejection unit configured to eject water from the supply aperture to at least one of an interior surface of the tub cover door or to the interior of the drum,
  - wherein the ejection unit comprises:
    - a chamber configured to guide the water supplied from the supply aperture; and
    - at least one chamber discharge unit configured to discharge water introduced into the chamber to the at least one of the interior surface of the tub cover door or the interior of the drum,
    - wherein the at least one chamber discharge unit comprises a first chamber discharge unit configured to tilt and discharge water at an angle towards the interior surface of the tub cover door.

2. The laundry treatment apparatus according to claim 1, wherein a cross-sectional area of the at least one chamber discharge unit is smaller than a cross-sectional area of the ejection unit.

3. The laundry treatment apparatus according to claim 1, wherein the tub cover door comprises:
- a frame rotatably coupled to the tub cover; and
- a window provided in the frame, the window comprising a transparent material, and
- wherein the first chamber discharge unit is configured to tilt and discharge water at an angle towards the window of the tub cover door.

4. The laundry treatment apparatus according to claim 1, wherein the at least one chamber discharge unit of the ejection unit further comprises a second chamber discharge unit that is configured to discharge water from the chamber to the interior of the drum.

5. The laundry treatment apparatus according to claim 4, wherein
- the drum comprises a drum body that is cylindrical in shape and that has the first opening of the drum defined at an upper portion of the drum body, and
- the second chamber discharge unit is configured to eject the water toward at least one of a bottom surface of the drum body or a side surface of the drum body.

6. The laundry treatment apparatus according to claim 5, wherein the second chamber discharge unit is provided in an edge of a lower part of the chamber and in a middle portion of the lower part of the chamber.

7. The laundry treatment apparatus according to claim 1, further comprising:
- a rotating shaft configured to rotate a drum body of the drum, wherein the tub cover further comprises at least one washing component configured to, in a state in which the drum body is rotated by the rotating shaft inside the tub body, guide at least a portion of water that is rotated inside the tub body in a direction away from a periphery of the tub cover and toward a center of the tub cover.

8. The laundry treatment apparatus according to claim 7, wherein the rotating shaft is configured to extend from a bottom surface of the tub body toward the second opening of the tub cover.

9. The laundry treatment apparatus according to claim 8, wherein the at least one washing component comprises a first washing guide that extends from a peripheral edge of the tub cover toward the second opening formed through the tub cover.

10. The laundry treatment apparatus according to claim 9, wherein the at least one washing component further comprises at least one washing guide discharge unit configured to discharge water supplied through the first washing guide in a direction towards the tub cover door.

11. The laundry treatment apparatus according to claim 10, wherein the at least one washing component comprises a plurality of washing component, with at least two of the plurality of washing component being arranged to face each other.

12. The laundry treatment apparatus according to claim 11, wherein the first guide of the at least one washing component comprises:

a first direction washing guide configured to, in a first state in which the drum body is rotated by the rotating shaft in a clockwise direction inside the tub body, guide the at least portion of water that is rotated inside the tub body in the direction away from a periphery of the tub cover and toward the center of the tub cover; and a second direction washing guide configured to, in a second state in which the drum body is rotated by the rotating shaft in a counterclockwise direction inside the tub body, guide the at least portion of water that is rotated inside the tub body in the direction away from a periphery of the tub cover and toward the center of the tub cover.

13. The laundry treatment apparatus according to claim 12, wherein the at least one washing component further comprises a barrier that protrudes from the tub cover toward an upper portion of the drum, and the at least one washing guide discharge unit comprises:

a first washing guide discharge unit that is defined through the barrier and that is configured to discharge water supplied through the first direction washing guide; and a second washing guide discharge unit that is defined through the barrier and that is configured to discharge water supplied through the second direction washing guide.

14. The laundry treatment apparatus according to claim 13, wherein each of the first washing guide discharge unit and the second washing guide discharge unit is inclined such that a path of water discharged from the first washing guide discharge unit and a path of water discharged from the second washing guide discharge unit cross each other.

15. The laundry treatment apparatus according to claim 1, further comprising:

a cabinet that defines an external appearance of the laundry treatment apparatus, the cabinet comprising the tub body and a drawer that is configured to support the tub body.

16. The laundry treatment apparatus according to claim 1, further comprising:

a rotating shaft configured to rotate a drum body of the drum, wherein the tub cover door comprises:

a frame rotatably coupled to the tub cover;

a window provided in the frame such that an inside of the tub body is visible from an outside of the tub body; and a second washing guide configured to, in a state in which the drum body is rotated by the rotating shaft inside the tub body, guide at least some of the water that is rotated inside the tub body in a direction away from a periphery of the window and toward a center of the window.

* * * * *